US011383130B2

(12) United States Patent
Wang

(10) Patent No.: US 11,383,130 B2
(45) Date of Patent: Jul. 12, 2022

(54) PELVIC FLOOR MUSCLE TRAINING DEVICE AND SYSTEM

(71) Applicant: Xiamen Brana Design Co., Ltd., Fujian (CN)

(72) Inventor: Zhongtang Wang, Fujian (CN)

(73) Assignee: XIAMEN BRANA DESIGN CO., LTD., Fujian (CN)

( * ) Notice: Subject to any disclaimer, the term of this patent is extended or adjusted under 35 U.S.C. 154(b) by 317 days.

(21) Appl. No.: 16/672,543

(22) Filed: Nov. 4, 2019

(65) Prior Publication Data

US 2020/0139192 A1 May 7, 2020

(30) Foreign Application Priority Data

Nov. 3, 2018 (CN) ..... 201811351183.6

(51) Int. Cl.

*A63B 23/20* (2006.01)
*A63B 24/00* (2006.01)
*A63B 71/06* (2006.01)

(52) U.S. Cl.

CPC ..... *A63B 23/20* (2013.01); *A63B 24/0062* (2013.01); *A63B 24/0084* (2013.01); *A63B 2024/0068* (2013.01); *A63B 2071/0638* (2013.01); *A63B 2209/00* (2013.01); *A63B 2220/17* (2013.01); *A63B 2220/40* (2013.01); *A63B 2220/56* (2013.01); *A63B 2220/62* (2013.01); *A63B 2220/75* (2013.01); *A63B 2225/20* (2013.01); *A63B 2225/50* (2013.01); *A63B 2230/06* (2013.01);

(Continued)

(58) Field of Classification Search

CPC . A63B 23/20; A63B 24/0062; A63B 24/0084; A63B 2024/0068; A63B 2071/0638; A63B 2209/00; A63B 2220/17; A63B 2220/40; A63B 2220/56; A63B 2220/62; A63B 2220/75; A63B 2225/20; A63B 2225/50; A63B 2230/06; A63B 2230/08; A63B 2230/207; A63B 2230/50; A63B 71/0605; A63B 2071/0666; A63B 2220/20; A63B 2220/80; A63B 2220/803; A63B 2220/833; A63B 2225/15; A63B 2225/54; A63B 2230/30; A63B 2230/60; G16H 20/30

See application file for complete search history.

(56) References Cited

U.S. PATENT DOCUMENTS 4,515,167 A 5/1985 Hochman
5,702,330 A 12/1997 De Monbrun et al.

(Continued)

FOREIGN PATENT DOCUMENTS

CN 101080210 B 5/2011
CN 203953665 U 11/2014

(Continued)

*Primary Examiner* — Sundhara M Ganesan
(74) *Attorney, Agent, or Firm* — Raymond Y. Chan; David and Raymond Patent Firm

(57) ABSTRACT

A pelvic floor muscle training device and system include a pelvic floor muscle training device, an intelligent terminal, a cloud server, a VR device, and a few application programs. The user does Kegel exercise wearing the training device, with the help of the VR device and scene induction, synergistic or independently, thus enhancing pelvic floor muscle function.

12 Claims, 5 Drawing Sheets

(52) U.S. Cl.
CPC ..... *A63B 2230/08* (2013.01); *A63B 2230/207* (2013.01); *A63B 2230/50* (2013.01)

(56) References Cited

U.S. PATENT DOCUMENTS

| | | | | |
|---|---|---|---|---|
| 7,001,317 | B2 | 2/2006 | Marcotte | |
| 7,448,989 | B2 | 11/2008 | Dana, III | |
| 8,512,226 | B2 | 8/2013 | Mark | |
| 8,870,724 | B2 | 10/2014 | Armitage et al. | |
| 9,084,915 | B2 | 7/2015 | Philip | |
| 9,186,545 | B2 | 11/2015 | Mandell | |
| 9,855,462 | B2 | 1/2018 | Rose | |
| 10,022,293 | B2 | 7/2018 | Scheuring et al. | |
| 11,045,246 | B1 * | 6/2021 | Schwartz | A61B 18/08 |
| 2005/0130818 | A1 * | 6/2005 | Karol | A63B 23/20 482/148 |
| 2005/0228316 | A1 * | 10/2005 | Morgenstern | A61N 1/0524 600/591 |
| 2009/0111671 | A1 * | 4/2009 | Campbell | A63B 21/0603 482/148 |
| 2014/0088471 | A1 * | 3/2014 | Leivseth | A63B 24/0087 601/89 |
| 2015/0196802 | A1 * | 7/2015 | Siegel | A63B 21/0085 482/8 |
| 2016/0279468 | A1 * | 9/2016 | Hung | A63B 71/0622 |
| 2016/0279469 | A1 * | 9/2016 | Rose | A63B 71/0622 |
| 2016/0346610 | A1 * | 12/2016 | Iglesias | A61B 5/4337 |
| 2018/0185641 | A1 * | 7/2018 | Peled | A61N 1/05 |
| 2018/0264317 | A1 * | 9/2018 | Yuan | A63B 23/20 |
| 2018/0289585 | A1 * | 10/2018 | Murison | A61H 19/44 |
| 2019/0160332 | A1 * | 5/2019 | Beer | A63B 24/0075 |
| 2019/0224041 | A1 * | 7/2019 | Nissenkorn | A61F 2/005 |
| 2020/0093413 | A1 * | 3/2020 | Hennings | A61B 5/4255 |
| 2020/0214617 | A1 * | 7/2020 | Sham | A61B 5/0024 |
| 2021/0161403 | A1 * | 6/2021 | Beer | A61B 5/7282 |

FOREIGN PATENT DOCUMENTS

| | | | |
|---|---|---|---|
| CN | 104436544 | B | 8/2016 |
| CN | 206651832 | U | 11/2017 |

* cited by examiner

PELVIC FLOOR MUSCLE TRAINING DEVICE AND SYSTEM

CROSS-REFERENCE TO RELATED APPLICATIONS

The present application claims the benefit of Chinese Patent Application No. 201811351183.6 filed on Nov. 3, 2018. The contents of the above are hereby incorporated by reference.

TECHNICAL FIELD

The present invention relates to the field of family health internet of things, in particular to a sharing pelvic floor muscle training device and operation system.

BACKGROUND

Repeated contraction-relaxation of the pelvic floor muscles of Kegel exercise not only strengthens the female perineal pelvic support system, treats urinary incontinence, improves the function of the perineal pelvic floor, but also reduces the incidence of prostate disease in male.

The training of Kegel exercise without an instrument-assisted is boring and difficult to maintain for a long time, because it is not to be seen, heard, and felt. Therefore, such behavioral therapies usually do not produce significant therapeutic effects.

A large number of Kegel exercise assisting equipment have been created, including female-specific training devices (CN203953665, CN101080210, CN104436544, U.S. Ser. No. 10/022,293B2, U.S. Pat. No. 8,512,226B2, U.S. Pat. No. 9,855,462B2, U.S. Pat. No. 7,001,317B2, U.S. Pat. Nos. 4,515,167, 9,084,915B2, 8,870,724B2), training effect monitoring devices (CN206651832), weight-suspended male-specific training devices (U.S. Pat. No. 9,186,545B2, U.S. Pat. No. 7,448,989B2, U.S. Pat. No. 5,702,330).

Most of these Kegel exercise assisting equipment have no feelings, treating the users as a rigid machine, without taking into account that the users are social animal with strong emotions, who need to be cared for, need fun, need to socialize, need cooperation, need encouragement, need love and to be loved.

If male and female users work together to do Kegel exercise, combined with virtual reality technology, they could dynamically see, hear, and feel the effects of training in real time, know the physical health status in real time, and furthermore, could freely communicate with others under the premise of data confidentiality, subsequently, the enthusiasm of the users pelvic floor muscle function training would be significantly improved, thus obtaining better training effects.

SUMMARY

The present invention is to provide a pelvic floor muscle training device and system, which is made into a sheet shape, and is assisted by VR device and scene induction to do Kegel exercise, in enjoyment mood, to achieve the purpose of enhancing the pelvic floor muscle function.

The pelvic floor muscle training device, which encapsulated into a sheet of silica gel, comprises a device main body and a traction wire, the device main body comprising a sensor module, a time-recorder, a counter, a central data processor, an IC chip, a power switch, a wireless communication module.

The sensor module includes two temperature sensors, a humidity sensor, a few pressure sensors, two displacement sensors, two acceleration sensors, an electromyography sensor, a pH sensor, two heart rate sensors, two blood pressure sensors, and two blood oxygen saturation sensors.

The pelvic floor muscle training system comprises the pelvic floor muscle training device, an intelligent terminal, a VR device, a cloud server, a few application programs, a personal data encryption module, and an identification module.

The user invokes the application programs to establish a link with the wireless communication module of pelvic floor muscle training device by using the intelligent terminal, and identify the user by using the identification module.

The user guides with the VR device, selects the induced scene, and enters the pelvic floor muscle function training mode.

Retrieving the previous pelvic floor muscle training data stored by the user in the cloud server, collecting the sensor module monitoring data, and the counter and the time-recorder monitoring data during the training of the user's pelvic floor muscle function, and encrypting the monitoring data by the personal data encryption module, then uploading to the cloud server.

The identification module uses blockchain technology for real-name authentication, the user inputs biometric information, and the blockchain network verifies the user identity by verifying the public key certificate chain.

The process includes the user signing a smart contract, setting a training plan and a training goal on the intelligent terminal, wearing the VR device and selecting an induced scene, identification, starting pelvic floor muscle training device, male and female users working together to perform pelvic floor muscle training, monitoring abnormal physiological data, then, the user receiving the warning information through said intelligent terminal, and taking timely responses, viewing the data analysis, comparison, and knowing the training results in said intelligent terminal, interacting with his or her partners or friends, and adjusting pelvic floor muscle training program if necessary.

DESCRIPTION OF ASPECTS OF THE DISCLOSURE

Figure 1:
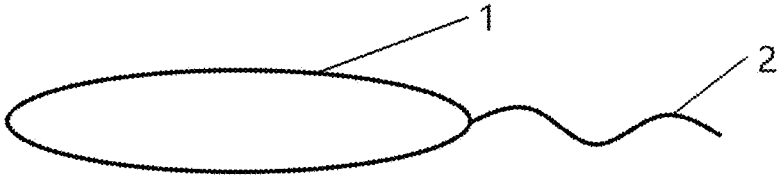
FIG. 1 is a top view of a typically shaped pelvic floor muscle training device, made according to the present invention.
Figure 2:
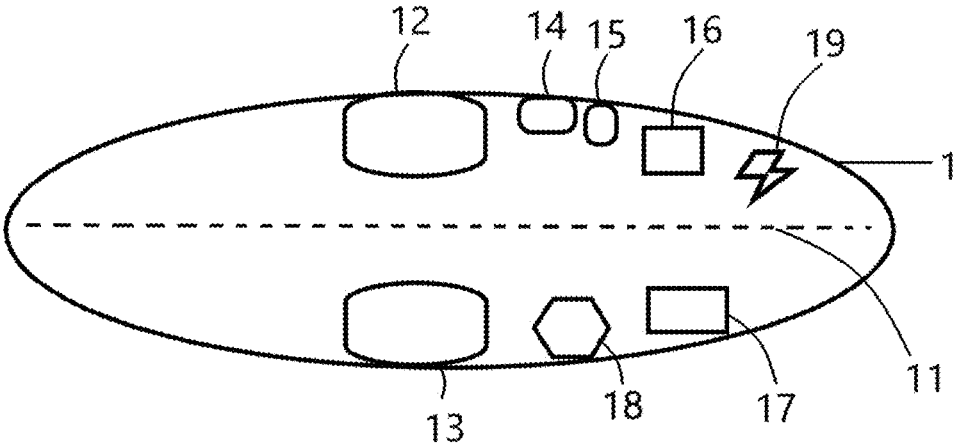
FIG. 2 is a schematic view showing a sagittal longitudinal cross-sectional structure of a typically shaped pelvic floor muscle training device, made according to the present invention.
Figure 3A:
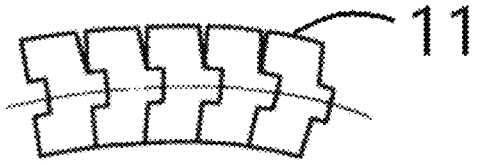
FIG. 3A is a schematic view of the hinge joint structure of pelvic floor muscle training device, made according to the present invention.
Figure 3B:
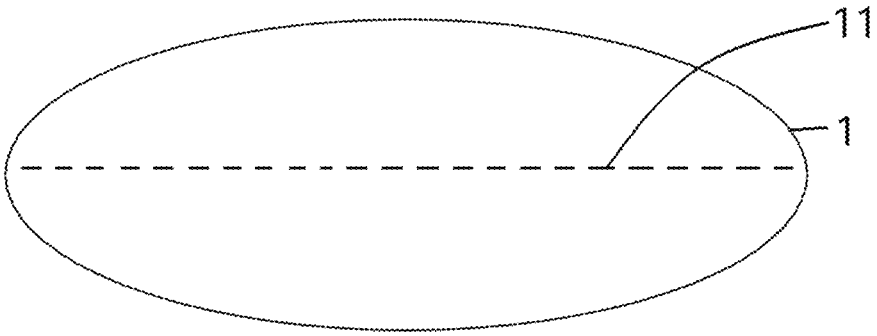
FIG. 3B is a schematic view of the pelvic floor muscle training device in a sheet shape, made according to the present invention.
Figure 3C:
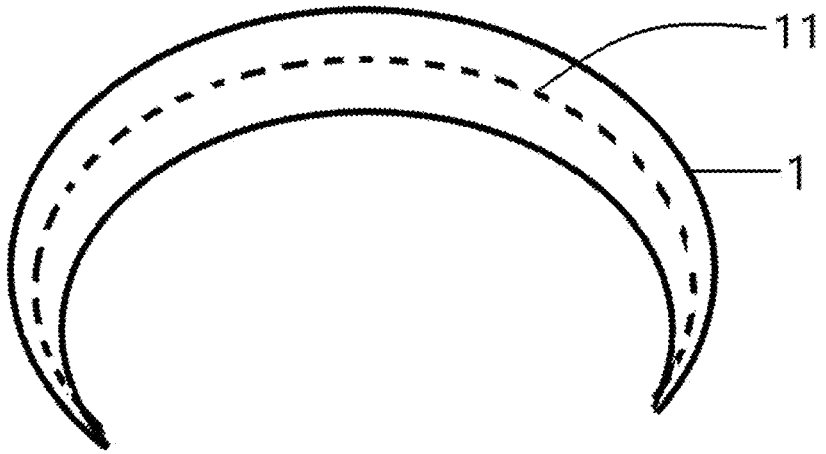
FIG. 3C is a schematic view of the pelvic floor muscle training device in a semi-annular status, having hinge-like soft skeleton embedded in liquid silica gel.
Figure 4:
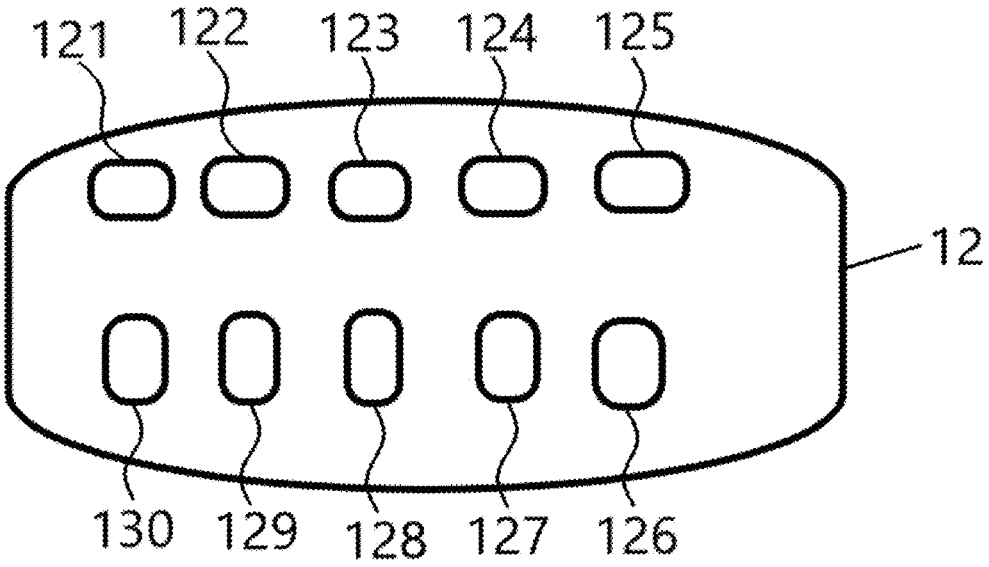
FIG. 4 is a schematic structural view of an outer side sensor module of the pelvic floor muscle training device, made according to the present invention.
Figure 5:
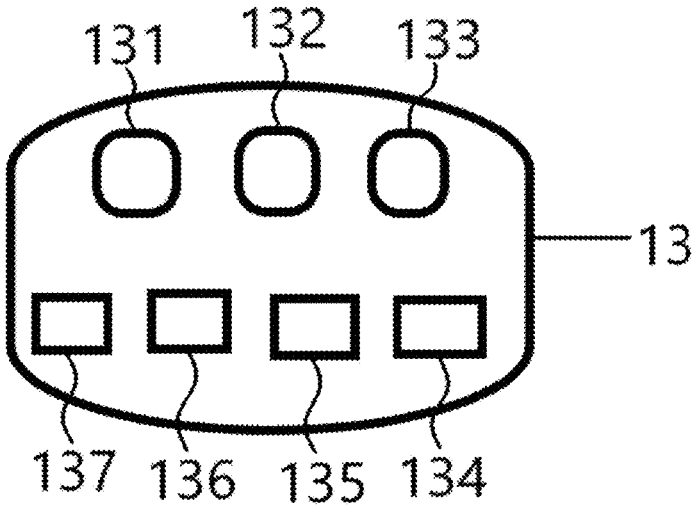
FIG. 5 is a schematic structural view of an inner side sensor module of the pelvic floor muscle training device, made according to the present invention.

For a detailed description of the technical contents, structural features, objects and effects of the present invention, the embodiments will be described in detail below with reference to the accompanying drawings. The invention comprises, consists of, or consists essentially of the following features, in any combination.

As shown in FIGS. 1 to 7B, the present invention discloses a pelvic floor muscle training device and system.

As illustrated in FIGS. 1 to 5, the pelvic floor muscle training device comprises a pelvic floor muscle training device main body 1 and a traction wire 2, wherein the outer layer of the pelvic floor muscle training device main body 1 is wrapped by medical grade liquid silicone. The traction wire 2 is 10 to 15 cm long and is made of medical grade silica gel with the hardness of 10 to 15 degrees, which is convenient for the users to control the pelvic floor muscle training device main body 1.

The inside of the pelvic floor muscle training device main body 1 is provided with a set of hinge joints 11 along the longitudinal axis. When the hinge joints 11 are in an extended status, the pelvic floor muscle training device main body 1 has a blade shape, and when the hinge joints 11 are bent, the pelvic floor muscle training device main body 1 exhibits a curl of different curvature to adapt to the characteristics of the user perineal organs.

The pelvic floor muscle training device main body 1 comprises an outer side sensor module 12, an inner side sensor module 13, a counter 14, a time-recorder 15, a power switch 16, a central data processor 17, an IC chip 18, and a wireless communication module 19.

The sensors of the outer side sensor module 12 and the inner side sensor module 13, the counter 14, and the time-recorder 15 are connected to the power switch 16, the central data processor 17, and the IC chip 18 by a cable, or by means of wireless.

The power switch 16 receives the user commands from the wireless communication module 19, and is controlled by a micro control unit of the IC chip 18.

The central data processor 17 collects and temporarily stores data of the outer side sensor module 12 sensors, the inner side sensor module 13 sensors, the counter 14, and the time-recorder 15. The previous data is uploaded and published to the cloud server 5 through the wireless communication module 19.

The outer side sensor module 12 comprises a temperature sensor 121, a humidity sensor 122, a pressure sensor 123, a displacement sensor 124, an acceleration sensor 125, an electromyogram sensor 126, a pH sensor 127, a heart rate sensor 128, a blood pressure sensor 129, and blood oxygen saturation sensor 130. The sensor probe is exposed on an outer surface of the outer side of the pelvic floor muscle training device main body 1, or is coated with a layer of transparent film. Wherein the pressure sensor 123, the displacement sensor 124, the acceleration sensor 125 and the electromyography sensor 126 may be provided in plurality to collect monitoring data of different muscles and different parts of the user pelvic floor during the training process.

The temperature sensor 121 is configured to collect body temperature data of a female user, so as to construct a body temperature database, and draw a menstrual physiological cycle curve of the female user through a specific algorithm, and determine an increase in physiological body temperature, or an increase in pathological body temperature.

The humidity sensor 122 collects environmental humidity data of the female user's vagina, so as to dynamic detect the vaginal secretion status in real time.

The pressure sensor 123 is configured to collect the muscle tension strength of the perineal pelvis of the female user during the training, so as to dynamic evaluate the tightness of the vagina.

The displacement sensor 124 collects quantitative data of the perineal tissue or organs movement amplitude when the users do Kegel exercise.

The acceleration sensor 125 collects movement acceleration data of the perineal tissue or organs when the users do Kegel exercise.

The electromyography module 126 is configured to collect biological function data of the perineal pelvic muscle group of the female use during training.

The pH sensor 127 is configured to collect the pH value of the user vaginal environment, and is used to construct the user perineal health database. If the user vaginal environment pH exceeds 5, the prompt result may be abnormal, thus reminding the user to seek medical treatment in time.

The heart rate sensor 128 is configured to collect female user heart rate data. When the heart rate exceeds the threshold value, the user may be reminded in time.

The blood pressure sensor 129 is configured to collect blood pressure data of the female user. When the blood pressure data exceeds a threshold, the user may be reminded promptly.

The blood oxygen saturation sensor 130 is configured to collect instantaneous oxygen saturation data of the female user. When the blood oxygen saturation exceeds a threshold, the user may be reminded in time.

The counter 14 is used for recording the number of times the user's single pelvic floor muscle training, so as to construct a database of accumulated training times calculated on a weekly, monthly, quarterly, and annual basis.

The time-recorder 15 is used for recording the start time and duration of the user's single pelvic floor muscle training, so as to construct a cumulative training time database calculated on a weekly, monthly, quarterly, and annual basis.

The inner side sensor module 13 comprises a temperature sensor 131, a pressure sensor 132, a displacement sensor 133, an acceleration sensor 134, a heart rate sensor 135, a blood pressure sensor 136, and a blood oxygen saturation sensor 137. The sensor probe is exposed to the inner surface of the inner side of the pelvic floor muscle training device main body 1, or coated with a layer of apparent film. Wherein the pressure sensor 132, the displacement sensor 133, and the acceleration sensor 134 may be provided in plurality to collect monitoring data of different parts of the user pelvic floor muscle.

The temperature sensor 131 is configured to collect body temperature data of a male user, so as to construct a body temperature database, to obtain a blood filling and local blood circulation of the male user penis through a specific algorithm.

The pressure sensor 132 is configured to collect the muscle tension value of the male user perineal pelvis during the training of the pelvic floor muscle function.

The displacement sensor 133 collects quantitative data of organ movement amplitude when the male user does Kegel exercise.

The acceleration sensor 134 collects quantitative data of organ movement speed and acceleration when the male user does Kegel exercise.

The heart rate sensor 135 is configured to collect heart rate data of the male user. When the heart rate data exceeds a threshold, the user may be promptly reminded.

The blood pressure sensor 136 is configured to collect blood pressure data of the male user. When the blood pressure data exceeds a threshold, the user may be promptly reminded.

The blood oxygen saturation sensor 137 is configured to collect real-time oxygen saturation data of the male user. When the blood oxygen saturation exceeds a threshold, the male user may be reminded in time.

The wireless communication module 19 is configured to send and receive data, including but not limited to any combination of one or more of ZigBee, WLAN (Wi-Fi), Bluetooth, NFC, and RFID.

Figure 6:
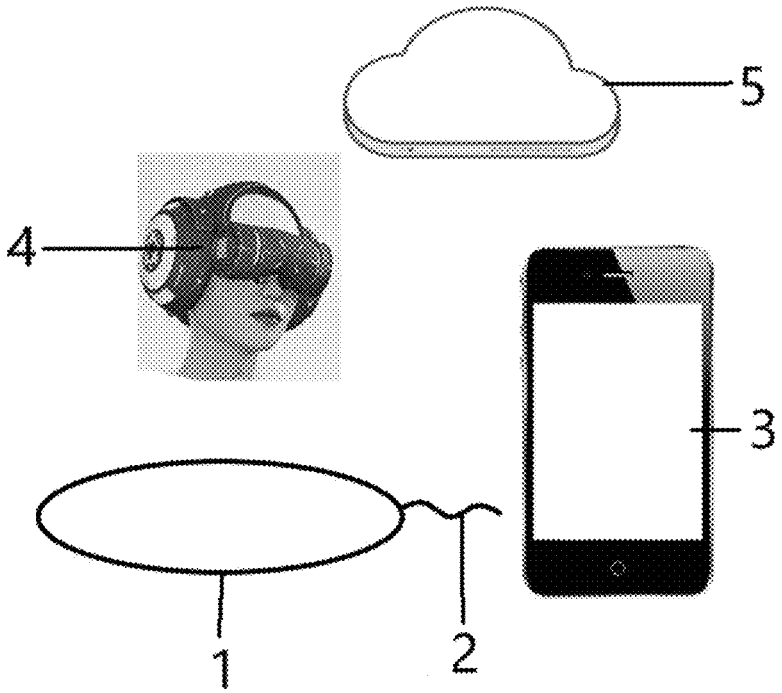
FIG. 6 is a schematic diagram of the pelvic floor muscle training system, made according to the present invention.

Referring to FIG. 6, the pelvic floor muscle training system comprises the pelvic floor muscle training device main body 1, an intelligent terminal 3, a VR device 4, a cloud server 5, a few application programs, a personal data encryption module, and an identification module.

The user enables the application programs with the intelligent terminal 3 to establish a link with the wireless communication module 19 of the pelvic floor muscle training device main body 1, and the user is identified by the identity module.

The user guides with the VR device 4, selects the induction scene, enters the pelvic floor muscle training status. The user can also invite others to enter the same induction scene for multi-person collaborative training.

Data of previous pelvic floor muscle training stored by the users in the cloud server 5, and data of the outer side sensor module 12, the inner side sensor module 13, the counter 14 and the time-recorder 15 collecting during training is encrypted by the data encryption module, and is distributed to the cloud server 5. Wherein monitoring data of sensors of the external sensor module 12 and the inner sensor module 13 are processed by using a specific algorithm to obtain dynamic data and summary data of the pelvic floor muscle training.

The users may further set a threshold of the monitoring data through the intelligent terminal 3 and/or the VR device 4. When the monitoring data exceeds the threshold, the users may be informed in real time.

The cloud server 5 constructs a user training database, analyzes user training data, and provides the user with pelvic floor muscle health data in a dynamic or arbitrary time period through a specific algorithm. The application programs capture abnormal data of the user, promptly alert the user, and make further medical advice to the user.

According to the smart contract authorization, the user obtains the pelvic floor muscle training data of other users on the blockchain, including the rank, mean and median value of the same user. The user could know other people training data based on age group, race, geographical distribution, disease spectrum, and special hobbies. Compared with the others, the user could know his or her training performance rankings, thus increasing training enthusiasm.

The user could also interact with his or her partners, friends, and strangers in the community to adjust the pelvic floor muscle training program, so as to achieve better training results.

The intelligent terminal 3 includes, but is not limited to, a smart phone, a smart watch, a smart tablet, a computer, a smart home appliance, a smart car, a smart mirror, and smart furniture.

The VR device 4 comprises an intelligent display helmet, a pair of smart glasses and an accessory device connects through a wireless communication module 19 to implement human-computer interaction. The human-computer interaction mode includes, but is not limited to, voice, gesture, eyeball tracking, and brain-computer interface.

The application programs comprise the pelvic floor muscle training device main body 1 application program, the VR device 4 application program, the intelligent terminal 3 application program, a user-defined application program. Wherein the user-defined application program is programmed by the user through a programming language or natural language code written according to the user own training habits.

The identity module uses blockchain technology for real-name authentication. The user signs a smart contract, creates a personal private key and a personal public key, and sends a personal public key, biometric information, and identity card information to the blockchain network to generate a block. Obtaining a public key certificate chain, the user inputs the biometric information, and the blockchain network verifies the user identity by verifying the public key certificate chain.

The personal data encryption module creates a user personal data center through blockchain technology, and stores and distributes the user personal data. The connection of the personal data center, the Internet, the Internet of Things, and the public cloud is completely based on the user-authorized blockchain intelligence contract. The personal data is written into the block in real time, and is released to the public cloud blockchain by the user to implement the security isolation of the personal data. The personal data may be authorized to read by a third person, in addition to the user's free distribution, storage, and use.

Figure 7A:
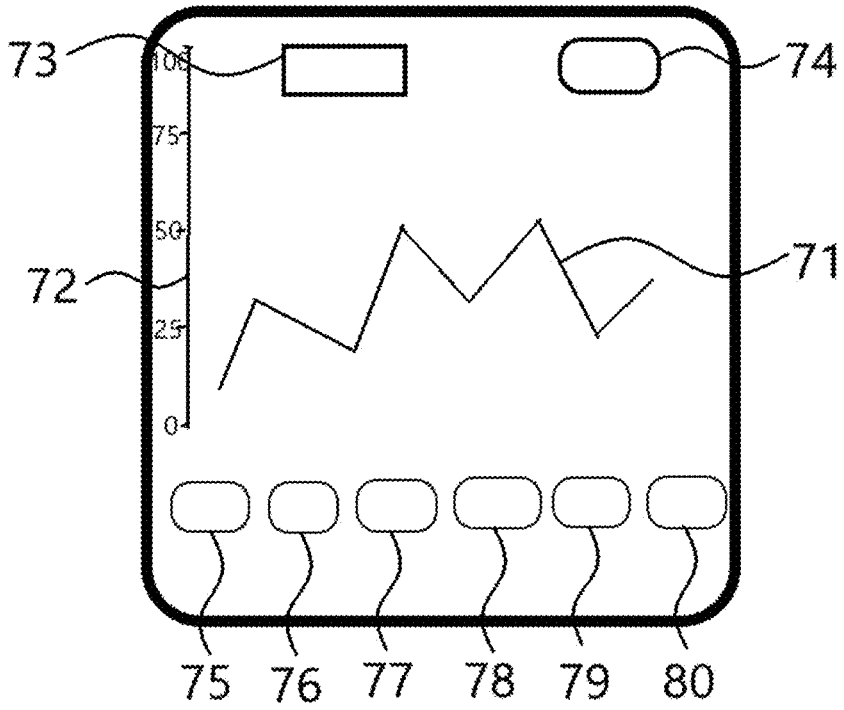
FIG. 7A is a schematic diagram of a typically display interface of intelligent terminal, showing items of temperature, humidity, muscle tension strength, amplitude, acceleration, and electromyogram, made according to the present invention.

Referring to FIG. 7A, the intelligent terminal 3 displays a dynamic curve 71 of the monitoring data in the center of the interface, and the left side of the interface displays the user monitoring data and the percentage flag 72 of the selected reference population. The upper left side of the interface is the monitoring item name 73, and the upper right side of the interface is the selection reference. The crowd category 74 has a temperature option button 75, a humidity option button 76, a muscle tension option button 77, a motion amplitude option button 78, a motion acceleration option button 79, and a muscle group electromyography option button 80, respectively.

Figure 7B:
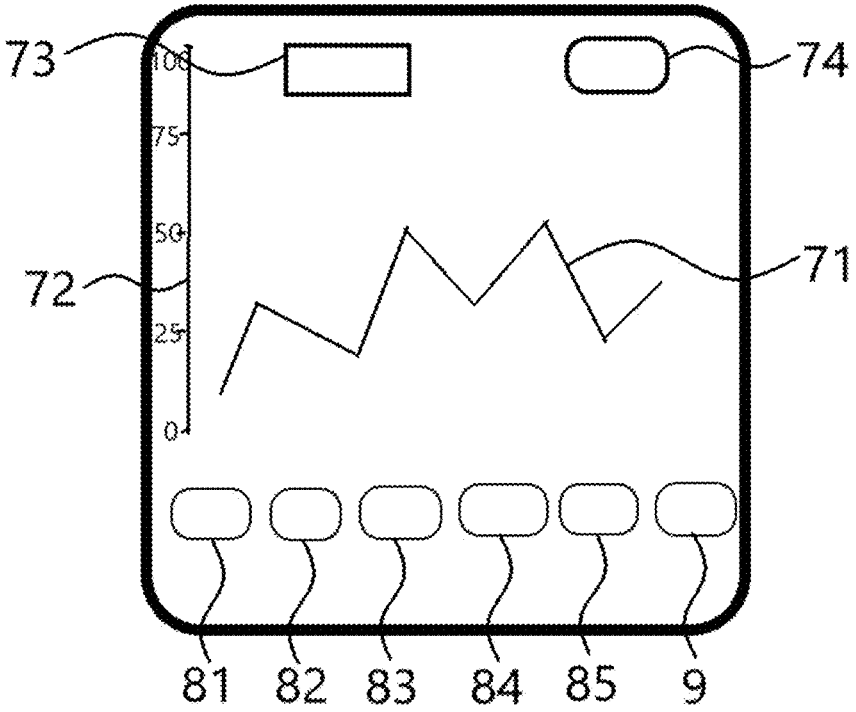
FIG. 7B is a schematic diagram of a typically display interface of intelligent terminal, showing items of heart rate, blood pressure, blood oxygen saturation, training duration, training time, and reference population selection, made according to the present invention.

Referring to FIG. 7B, the intelligent terminal 3 interface lower-end option button could be left and right touch slide, and could also display heart rate option button 81, blood pressure option button 82, blood oxygen saturation button 83, training duration option button 84, training number option button 85, and reference crowd option button 9, respectively.

The user application scenarios include male and female users in coordination with pelvic floor muscle training, male users' individual pelvic floor muscle training and female users' individual pelvic floor muscle training, respectively.

A process using above-described device and system with the male user and the female user collaborative performing would, typically, comprise the following steps:

1. the users signing the smart contract;
2. identification of male and female users;
3. the users setting a training program, a training goal, and a threshold with intelligent terminal or the VR device;
4. the users wearing the pelvic floor muscle training device;
5. the users wearing the VR device, and selecting an induced scene;
6. the users entering the training status;
7. the users starting the pelvic floor muscle training device, cooperating each other for functional training;
8. monitoring data being collected during the training process;
9. when abnormal physiological data being monitored, the intelligent terminal sending a message to the users to take measures in time;
10. when frequently showing invalid training action, the user being promptly reminded to improve the training mode, or take a rest properly;
11. the data monitored by the sensors, the time-recorder, and the counter being combined to generate the pelvic muscle training summary data, which is encrypted and uploaded to the cloud server;
12. the cloud server creating a user training database, analyzing user training data, and providing user with pelvic floor muscle health data and medical advice;
13. compared training data with other users, the users earning his or her training performance rankings, thus increasing training enthusiasm; and
14. the users interacting with partners, friends, or strangers in the community to adjust the pelvic floor muscle training program, so as to obtain good training results.

While the user performs the pelvic floor muscle training alone, the process would, typically, comprise the following steps:

1. the user signing the smart contract;
2. identification of the user;
3. the user setting a training program, a training goal, and a threshold with intelligent terminal or the VR device;
4. the male user wearing the pelvic floor muscle training device on the naked penis, or the female user inserting the assembled pelvic floor muscle training device into the vagina, wherein the assembled pelvic floor muscle training device comprising of a pelvic floor muscle training device and a penis-like project;
5. the user wearing a VR device, and selecting an induced scene;
6. the user starting the pelvic floor muscle training device for functional training;
7. monitoring data collecting during the training process;
8. when abnormal physiological data being monitored, the intelligent terminal sending a message to the user to take measures in time;
9. when frequently showing invalid training action, the user being promptly reminded to improve the training mode, or take a rest properly;
10. the data monitored by the sensors, the time-recorder, and the counter being combined to generate the pelvic muscle training summary data, which being encrypted and uploaded to the cloud server;
11. the cloud server creating a user training database, analyzing user training data, and providing the user with pelvic floor muscle health data and medical advice; and
12. compared with other users training data, the user being able to know his or her training performance rankings, thus increasing training enthusiasm.

The user implements the training program including: (a) using the pelvic floor muscle training device 1 alone; (b) using the pelvic floor muscle training device 1 in combination with the cloud server 5, (c) using the pelvic floor muscle training device 1 in combination with the intelligent terminal 3, and the cloud server 5, and (d) using the pelvic floor muscle training device 1 in combination with the intelligent terminal 3, the cloud server 5, and the VR device 4.

It is to be understood that while the invention has been described in conjunction with the detailed description thereof, the foregoing description is intended to illustrate and not limit the scope of the invention, which is defined by the scope of the appended claims. Other aspects, advantages, and modifications are within the scope of the following claims.

What is claimed is:

1. A pelvic floor muscle training device, which encapsulated into a sheet of silica gel, comprising a device main body and a traction wire, wherein said device main body comprises a sensor module, a time-recorder, a counter, a central data processor, an IC chip, a power switch, and a wireless communication module, wherein said sensor module comprises two temperature sensors, a humidity sensor, a plurality of pressure sensors, two displacement sensors, two acceleration sensors, an electromyography sensor, a pH sensor, two heart rate sensors, two blood pressure sensors, and two blood oxygen saturation sensors, wherein said time-recorder is used to record a start time, an end time, and a duration of user training, wherein said counter is used to record a training frequency and a number of user Kegel exercise.

2. The pelvic floor muscle training device according to claim 1, wherein said two temperature sensors, which are disposed on an inner side and an outer side of said device main body, are used for collecting body temperature data of male user and female user respectively, constructing a body temperature database, and drawing a menstrual physiological cycle curve of the female user and determining an increased body temperature in a physiological status or under disease conditions, and also reflecting the blood circulation of the pelvic floor muscles.

3. The pelvic floor muscle training device according to claim 1, wherein said humidity sensor is disposed on an outer side of said device main body.

4. The pelvic floor muscle training device according to claim 1, wherein said displacement sensors collect a movement range of a pelvic floor tissue when users do Kegel exercise.

5. The pelvic floor muscle training device according to claim 1, wherein said acceleration sensors collect a moving acceleration of a pelvic floor tissue when a user does Kegel exercise.

6. The pelvic floor muscle training device according to claim 1, wherein said pressure sensors are disposed on an inner side and an outer side of said device main body, which number is not less than two, and are used for collecting a pelvic muscle tension strength during a training process of a male user and a female user respectively.

7. The pelvic floor muscle training device according to claim 1, wherein said electromyography sensor is disposed on an outer side of said device main body, and is configured to collect pelvic floor muscle data during user training.

8. The pelvic floor muscle training device according to claim 1, wherein said pH sensor is disposed on an outer side of said device main body for collecting a pH value of a female user vaginal environment, and is used for constructing a female user vaginal internal environment health database.

9. The pelvic floor muscle training device according to claim 1, wherein said heart rate sensors are disposed on an inner side surface and an outer surface of said device main body, and are used to collect heart rate data of male and female users respectively.

10. The pelvic floor muscle training device according to claim 1, wherein said blood pressure sensors are disposed on an inner side surface and an outer side surface of said device main body, and are configured to collect blood pressure data of a male user and a female user respectively.

11. The pelvic floor muscle training device according to claim 1, wherein said blood oxygen saturation sensors are disposed on an inner side surface and an outer side surface of said device main body for collecting blood oxygen saturation data of a male user and a female user respectively.

12. The pelvic floor muscle training device according to claim 1, wherein said IC chip includes a micro control unit that receives a user command.

* * * * *